United States Patent [19]

Morgan

[11] 4,029,092

[45] June 14, 1977

[54] COMPARTMENTALIZED FULL FACE MASK

[75] Inventor: Bevly Boone Morgan, Santa Barbara, Calif.

[73] Assignee: U. S. Divers Co., Santa Ana, Calif.

[22] Filed: Sept. 17, 1973

[21] Appl. No.: 397,824

[52] U.S. Cl. ..... 128/141 R; 128/142.4; 128/145 A

[51] Int. Cl. ..... A62b 7/02

[58] Field of Search ..... 128/141 R, 141 A, 142, 128/142.2, 142.3, 145 R, 145 A, 146, 146.4, 146.7, 203, 205; 2/2.1 R, 9

[56] References Cited

UNITED STATES PATENTS

| | | | |
|---|---|---|---|
| 439,093 | 10/1890 | Barian | 128/142.2 |
| 2,168,695 | 9/1938 | Asari | 128/145 A |
| 2,488,261 | 11/1949 | Bedini | 128/142 |
| 3,064,089 | 11/1962 | Ward | 128/141 A |
| 3,181,531 | 5/1965 | Angioletti | 128/141 R |
| 3,521,626 | 7/1970 | Hashimoto et al. | 128/142 |
| 3,572,332 | 3/1971 | Wise | 128/141 R |
| 3,680,556 | 8/1972 | Morgan | 128/142.2 |

*Primary Examiner*—Richard A. Gaudet
*Assistant Examiner*—Henry J. Recla
*Attorney, Agent, or Firm*—George Frazier Bethel; Patience K. Bethel

[57] ABSTRACT

A compartmentalized full face mask having a flexible sealing flange around the periphery thereof for sealing the body of the mask against a diver's face. The body of the mask has an upper facially oriented opening for receipt of a viewing lens, and a lower opening for receipt of an accessory plate. The lens and accessory plate are secured in the face mask by a band which circumscribes the outer periphery of the body of the face mask for tightly holding the viewing lens and accessory plate in a groove in the body of the mask.

The lens and accessory plate partially define an upper and lower chamber with a nose portion and a sealing flange dividing them. The sealing flange provides a lower chamber which can be utilized with accessories of various types in a manner not possible in the prior art. The lower chamber also serves to enhance the underwater sound transmission capabilities of the mask.

The lower chamber in one configuration of accessory plate receives a plug in its accessory plate or other opening, for attachment to a second stage regulator or other breathing device. The plug can be moved and substituted by various accessories as well as providing an overall adjustability of the mask with respect to the diver's mouth. The mask is held on a diver's head by means of an elastomeric spider having adjustable attachment means connected to the peripheral portions of the mask.

9 Claims, 9 Drawing Figures

COMPARTMENTALIZED FULL FACE MASK

BACKGROUND OF THE INVENTION

1. Field of the Invention

The field of this invention lies within the diving art, as it specifically relates to masks and the accessory portions thereof.

2. The Prior Art

Prior Art underwater diving masks comprise face masks which generally surround the area of the eyes and the forehead. These masks have a face plate which allows the diver to view underwater objects therethrough.

It has been found that the foregoing masks are quite usable by people in warm water, and those who dive on a limited basis. However, it has also been found that more protection and greater extended usage is oftentimes required in a diving mask. Specifically, commercial divers and divers that dive for extended periods of time have tried to develop various masks and helmets to cover the entire facial area. These masks have taken the form of masks attached to hoods, masks in combination with hoods, masks having an extended full face coverage, and masks and helmets which cover the entire head.

In all of the foregoing types of masks, there has been a substantial tendency to develop a mask which covers the entire and frontal area with a single cavity. The single cavity concept has led to many difficulties. Oftentimes it is desirable to maintain visibility through the cavity while at the same time doing some other function within the cavity which is not compatible therewith. This invention is in part directed toward solving the foregoing problem.

Certain types of the foregoing masks incorporate oral nasal coverings for receipt of breathing gas which is delivered under pressure thereto. The oral nasal coverings are generally flexible and can be superimposed over a diver's mouth and nose in a manner consonant with the techniques used in providing oxygen to aviators.

The foregoing oral nasal coverings, although allowing a diver to receive breathing gas in a discrete manner, do not provide the comfort, flexibility, or capability of meeting many requirements of a diver. Specifically, prior art masks have not provided a limitation of the buildup of deleterious gases which are exhaled by a diver. Such buildups can sometimes cause blackouts which can seriously endanger the life of a diver. Also, the combination of the gas buildup and depth at which many commercial divers dive, creates a situation which can endanger the diver.

Many prior art diving masks have tried to effectuate the use of communications equipment therewith. Such masks have generally not placed the communications equipment in its optimum location because of the configuration of the mask. The inability to speak into an area which can pick up one's speech is one of the primary faults of prior art diving masks. A separate "speech cup" has been used in conjunction with prior art masks. However, it is impractical due to its attendant sealing problems and additional securing straps.

As an aside, many of the masks of the prior art have not solved the problem of exposure to a diver's lower facial features. In addition thereto, many of the prior art masks that are full face masks have not allowed the utilization of snorkles and accessory breathing equipment. This is very important when a diver is in a swimming situation and does not or cannot use the breathing gas from his tank.

This invention overcomes the foregoing deficiencies by eliminating the buildup of deleterious gases, thereby helping to stop blackouts and attendant dangerous conditions for divers. In addition thereto, this invention allows the use of communications equipment in adjacent relationship to a diver's mouth so that he can speak without any hindrance. Also, the design of this invention provides a means for transmitting speech diaphragmatically through the water to another diver in close proximity to the speaker.

It has become paramount in diving for the diver to communicate verbally and this is extremely difficult with prior art masks. As a result, full face masks have been devised to be used with recirculators that will hold in overpressure and seal out water upon underpressure.

Such prior art masks are not fully effective and leak in most cases. The difficulty of achieving a full face seal when using a recirculator is due to the enlarged area of the seal. An average full face seal has over thirty square inches of area. At 0.500 psi overpressure, this results in 15 lbs. of force attempting to move the full face mask away from the diver's face. Any slight movement usually spoils the seal and allows the venting of breathing gas out of the recirculator which is not desirable, inasmuch as these units have a very limited volume of gas supply.

The present invention allows the diver to make use of an advantageous mouthpiece and lip seal, when not communicating, or in the event of an emergency flooding of the mask.

This invention also serves to protect the lower part of a diver's face and provide a comfortable seal on the upper lip. Furthermore, it allows the function of breathing to be separated from the viewing function. This becomes of utmost importance when the diver's breathing gas becomes exhausted. Also, the diver can surface, or use another breathing system without losing vision due to the flooding of the viewing area.

In addition to the foregoing features, this invention allows the use of a snorkle and other accessories to be inserted into a diver's mouth or into the lower cavity of the mask at the diver's option. The invention provides for a changing of the accessory plate so that accessories such as microphones and other devices such as recirculator breathing apparatus can be utilized. In addition to the foregoing, the plate allows for a double as well as a single hose second stage regulator to be utilized by a diver in the oral cavity area.

All the foregoing features are not provided by the prior art and help to establish this invention as a distinct step over the prior art as to its particular configuration and function.

SUMMARY OF THE INVENTION

In summation, this invention comprises a superior diving mask having a full frontal facial configuration separated by a web or flanged partition providing an upper and lower chamber.

More specifically, the invention incorporates a mask having an outer flanged area for sealing against a diver's face. Two inner cavities comprising an upper and lower cavity respectively for viewing and breathing purposes are separated by the web. The upper cavity has a viewing lens therein, and the lower cavity has an opening molded therein or a plate for receipt of a plug, or other accessories. The plug can be connected to a second stage one or two hose breathing gas regulator. In addition thereto, communications means can be provided in the form of diaphragmatic resonant communication means, microphones, and other electrical devices oriented therein.

The entire mask can be fitted and secured to a diver's facial features by means of an elastomeric spider comprising a plurality of fastening means attached to the mask and directly affixed to each other at a central location that can be placed at the back of a diver's head.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
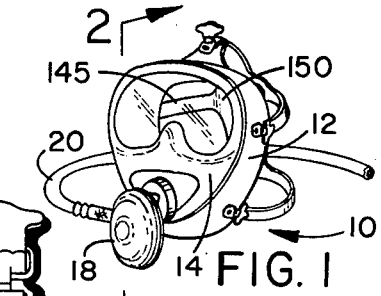
FIG. 1 shows a diving mask of this invention in its frontal perspective relationship.
Figure 2:
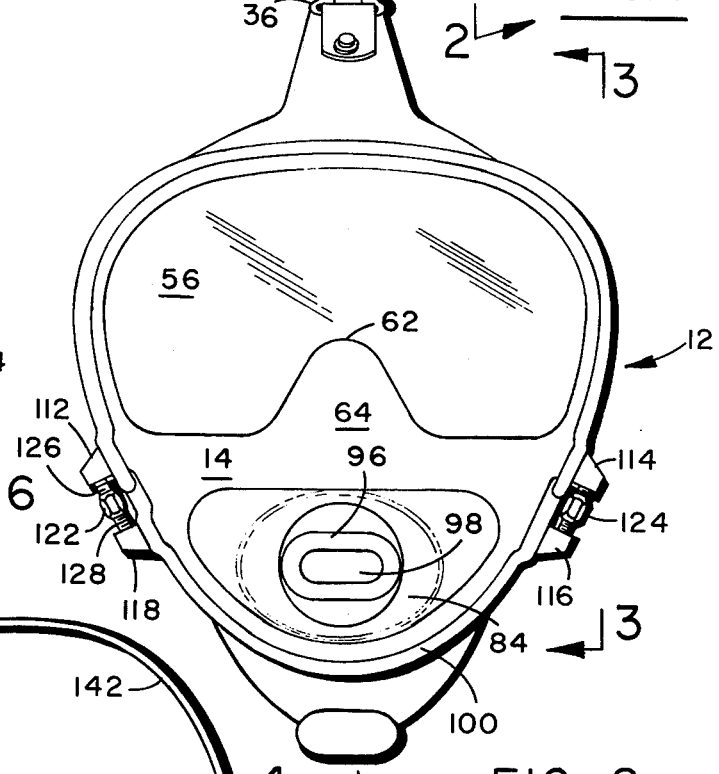
FIG. 2 shows a front elevation view of the diving mask along lines 2—2 of FIG. 1.
Figure 3:
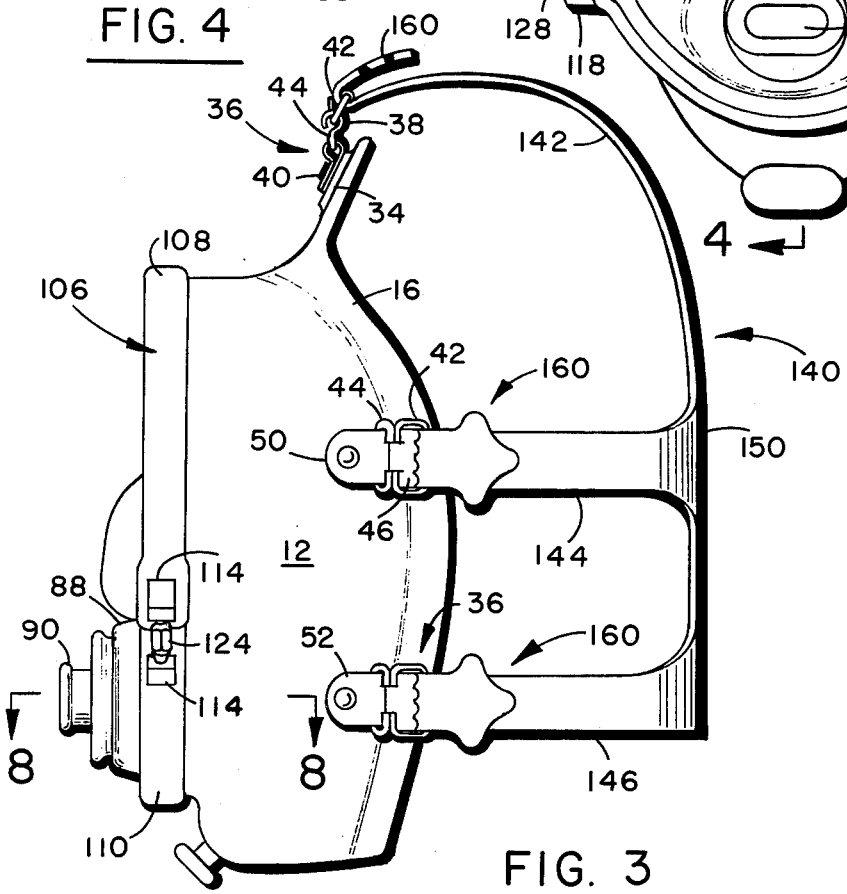
FIG. 3 shows a side elevation view of the diving mask in the direction of lines 3—3 of FIG. 2.
Figure 5:
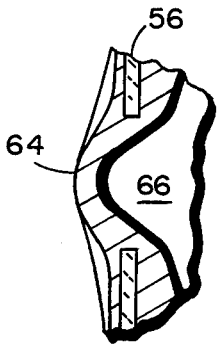
FIG. 5 shows a fragmented sectioned view along lines 5—5 of FIG. 4.
Figure 7:
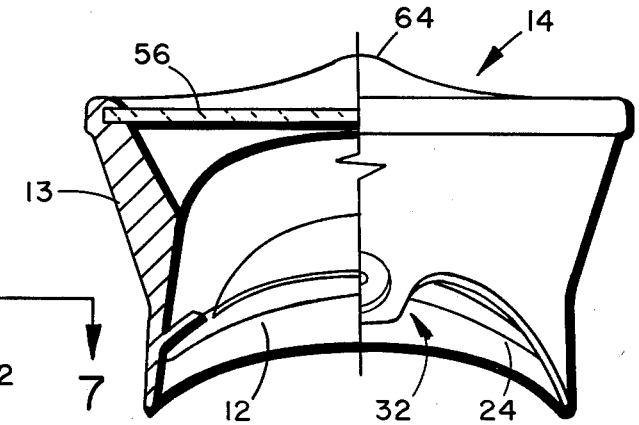
FIG. 7 shows a partially sectioned view of the invention along lines 7—7 of FIG. 6.
Figure 6:
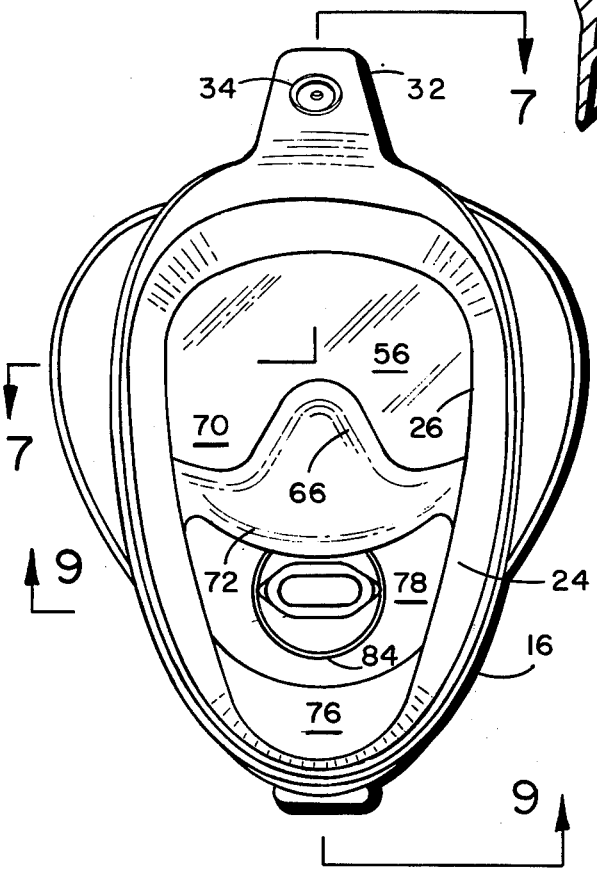
FIG. 6 shows an interior view of the mask from the rear portion thereof in the direction of lines 6—6 of FIG. 4.
Figure 8:
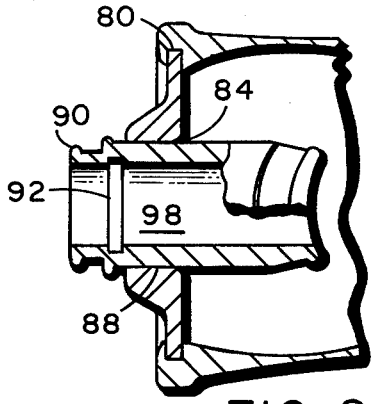
FIG. 8 shows a sectioned view of the details of the accessory plate and plug therein along lines 8—8 of FIG. 3; and, FIG. 9 shows a partially sectioned view through the lower portion of the mask along lines 9—9 of FIG. 6.
Figure 9:
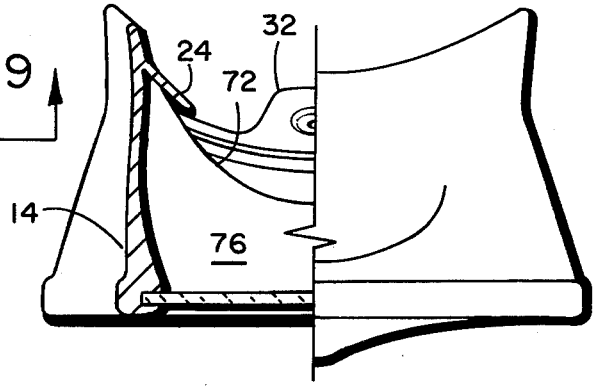

Looking particularly at FIG. 1 a mask 10 is shown having a main body portion comprised of side walls 12. The main body portion side walls 12 are generally eliptically shaped in a teardrop form. The main body portion has frontal face region 14 which is generally in a flattened or planar configuration except for the different portions thereof which will be described. The trailing edge comprises a rim or edge 16 which is configured to be placed against a user's face.

The mask 10 is seen attached to a second stage regulator 18 having a hose 20 leading therefrom. The hose 20 leads to a source of breathing gas that can be supplied from a first stage regulator or a secondary source such as a pump or pressure vessel. The second stage regulator 18 generally provides a regulation of breathing gas conducted thereto upon demand of a user. In other words, when a user breathes in it causes a deformation of the elements in the second stage regulator to permit a valving action thereof. This consequently provides a system of smooth breathing gas regulation.

The mask 10 has a generally flexible configuration throughout its body and is made of neoprene. However, the side walls 12 of the housing or main body portion have an upper portion 13 which is substantially thickened. This thickened area serves to rigidly resist overpressure from expanding the mask and breaking the seal as well as causing the mask to be supported on the upper facial structure.

Figure 4:
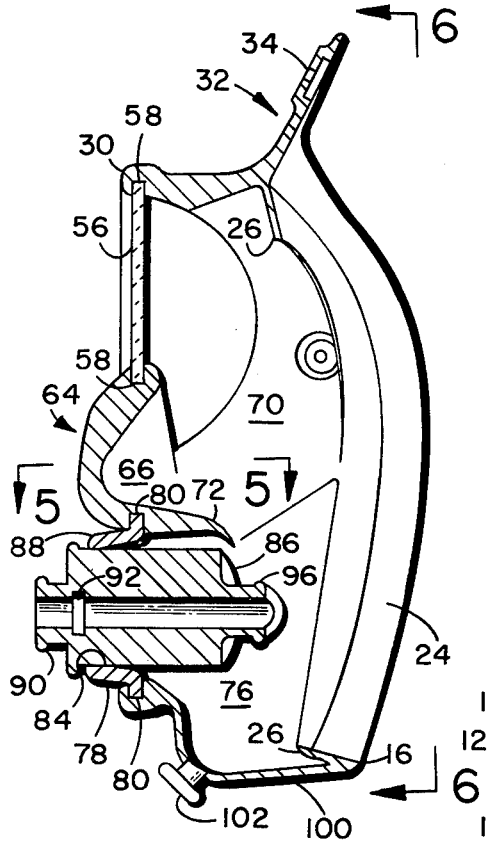
FIG. 4 shows a sectioned view through the center of the diving mask along lines 4—4 of FIG. 2.

The mask 10 is provided with an interiorly chamfered or tapered surface 24 which serves to place the mask in a sealed relationship. The thickened portion 13 is new in the art and provides a stiffness to the walls 12 not known in the art. As an aside, the thickened upper walls 13 serve to provide a reinforcement and support for the regulator attached to the mask. The lower walls are more flexible, thereby relieving the lower facial structure from substantial loading. Thus, the mask is mainly supported on a diver's face at the forehead and cheek bones. The surface 24 can be of a flexible elastomeric material having a continuity substantially throughout the entire periphery of the edge region 16 of the mask. A sealing surface 24 forms a flange 26 having a narrow edge which can flex and accommodate the various conformations of a diver's face. This enables a diver to receive a form fitting seal against his face, while at the same time a substantial degree of comfort. The sealing surface 24 generally projects inwardly of the mask to provide a self-seal under internal pressure except toward the top as seen in FIG. 4.

The mask 10 has an outer periphery around the frontal circumferential region in the form of a beaded portion 30 which serves to accommodate the frontal portions of the mask. The beaded portion 30 is a molded enlarged denser section for reinforcing purposes as well as for maintaining the different portions of the mask in situ therein, as will be explained.

The main body has side walls 12 which taper upwardly into an upstanding tab 32 having a buckle securement 34. The upstanding tab 32 is molded as a continuous portion of the side walls 12. The buckle attachment 34 receives a buckle 36 which can accommodate a strap which shall be described. The buckle 36 can be provided with a D ring, or other suitable means for holding a strap. Specifically, the buckle can be attached by a loop 38 which is riveted by a rivet 40 to the tab 32. The buckle 36 is also comprised of a ring 42 which is attached to a securement element 44. The securement element 44 can have a serrated gripping element 46 for locking the strap.

In order to attach the remaining securement means to the mask, a series of buckle attachment tabs are provided so that rivets or other means can attach the buckles 36 thereto. Specifically, a series of bilaterally symetrical tabs 50 are provided on each side of the walls 12 of the mask. These serve to support the buckles 32 and the rivet conformation so that they will not rip out. In other words, the tabs 50 and 52 can be enlarged and thickened portions of the side wall 12, so that they do not allow a ripping of the buckles 36 from their securement means. The securement means and buckles function in a similar manner as the buckle attached to tab 34. The securement means combined with a spider will be expanded upon after the details of the main body of the mask have been described.

Looking more particularly at the frontal area 14 of the mask, an upper viewing plate or lens 56 is shown. The upper viewing plate or lens 56 is seated within the walls of the mask 12 in a groove 58 which circumscribes an upper opening within the wall of the mask. The groove 58 of course, can be formed in any suitable manner as long as it provides a recess or seating of the lens 56. The plate 56 can be of a glass, plastic, or other unbreakable clear material for viewing purposes.

The plate or lens 56 is configured so that it has an indentation 62 which overlies a nose portion 64 formed in the main body of the mask. The nose portion 64, of course, is a projection of the mask which receives a user's nose in a space 66. The space 66 is configured so that a diver's nose can generally fit the conformation therein while at the same time providing a seal in the lower chamber as will be described.

The entire mask is generally comprised of an upper chamber 70 and lower chamber 76 defined and separated by a partition or flange 72 which extends from the nose section 64 inwardly against a diver's upper lip. In addition thereto, the lower compartment or chamber 76 is provided to at least partially enclose the chin and lower facial region of a diver. The partition or flange 72 is turned downwardly or toward the lower chamber 76. This creates a situation wherein the pressure in the lower chamber 76 accentuates the sealing thereof. The gas in the lower chamber 76 is overpressured. The seal 72 resists the gas from flowing into the upper chamber 70. Thus, this limits the square inches of overpressure area to the lower chamber which serves to limit the amount of force necessary to seal the mask. The lower region or chamber 76 also enables a diver to utilize diving accessories in other manners to be described.

The lower region can be provided with a sealing accessory plate 78 which is secured into a lower and upper circumferential groove 80 which circumscribes the lower opening. The upper circumferential groove 80, of course, is within the flange 72 or partition. The plate 78 can be configured in any suitable manner to provide an opening 84 through which a plug 86 can pass. The plug 86 can be sealed in the opening 84 of the plate 78 by any suitable means. Furthermore, the plate 78 can be configured so that is is planar with the general face of the mask to conform to the frontal planar surface 14 or it can conform with a generally outwardly extending flange 88. The outwardly extending flange 88 can be a truncated extension of the plate 78, or configured in any other suitable manner to accommodate the plug 86.

The plug 86 also has a frontal circumferential flange 90 and an interior groove 92. The foregoing serves to accommodate the outlet of a second stage regulator generally shown as a second stage regulator 18. A mouthpiece or trailing edge flange 96 is provided for a diver to put in his mouth and accommodate the direct passage of breathing gas from the second stage regulator 18 to his mouth. The gas, of course, passes through an eliptical opening 98 which axially passes through the plug 86.

The plug or insert 86 can be moved inwardly and outwardly within the opening 84 of the plate 78. This serves to accommodate the movement of the plug 86 into any particular position the diver so desires. In other words, the diver can effectuate movement of the plug 86 to a position outside of his oral opening or adjust it to a particular placement where the diver's oral opening is oriented. Furthermore, the plug 86 allows for a direct passage of breathing gas through the passageway 98 directly to a diver's mouth.

The unique mouthpiece 96 and plug combination 86 does not require that the diver hold the mouthpiece in place with his lips and teeth. The rubber plug 86 portion secures the mouthpiece 96 in place by its frictional engagement. This becomes important in cold water due to numbness weakening the diver.

The plug portion 86 of the mouthpiece slides in and out so that when the diver is not talking, the plug can slide until the mouthpiece enters his mouth. By clasping his lips on the mouthpiece 96, and excellent seal is formed to reduce dead air space, thus reducing the buildup of undesired exhaled gases. When the diver wishes to speak, the plug 86 can be slid forwardly allowing lip movement for speech. If adjusted properly, the diver can remove his lips from the mouthpiece of the plug 86 and talk, and then reseal his lips to the mouthpiece 96 without moving the plug.

When the mask is used in conjunction with a recirculator, the sliding plug 86 is a notable improvement over all the prior art masks. Depending upon the position of the breathing bags of the recirculator on the diver and the position of the diver in the water column relative to the bottom, the breathing bags will exert a plus, neutral, or negative pressure at the diver's mouth. When using this mask with a recirculator, this phenomenon is not a problem due to the lips providing a good sealing to the mouthpiece of the plug 86. Also, over or underpressure from breathing bag positioning rarely exceeds 0.5 psi (½ lb), thus presenting a pressure on the mouthpiece seal of 0.5. Inasmuch as the area of the mouthpiece 96 on the plug 86 is not over 1 square inch, this is quite easy for the diver to maintain.

The lower portion of the mask forming a chin receipt portion 100, can be provided with a purge valve 102 or placed in accessory plate 78. The purge valve 102 is commonly known in the art for purposes of allowing a forceable exit of water which possibly collects in the lower chin receipt portion 100.

The lower chamber 76 can have a diaphragm therein exposed to the surrounding environment. In addition thereto, the plate 78 can be formed of flexible material or substituted by a fully molded section formed as a portion of the remainder of the mask. In this manner, the lower cavity enhances the communication between divers without the need of wires or electricity. In other words, the front portion of the lower cavity 76 can be formed as a sound powered vibrating oscillator to transmit messages between divers at limited ranges.

The circumferential grooves 58 and 80 which respectively hold the lens plate 56 and the accessory securement plate 78 are held together by means of a circumferential band 106. The circumferential band 106 has an upper portion 108 and a lower portion 119. Each band has a projecting lug on either end thereof, namely lugs 112, 114, 116 and 118. The foregoing lugs are threaded by any suitable threading means in order to receive bolts in a manner to be described.

Two bolts 122 and 124 are provided on either side of the mask in order to secure the lugs 112, 114, 116 and 118 together. The bolts 122 and 124 have an upper right hand threaded portion 126 and a lower left hand threaded portion 128. As a consequence, when the bolts 122 and 124 are turned in their respective lugs, in which they are threaded, they tend to draw the band portions 108 and 110 together. By drawing the band portions 108 and 110 together, a securement of the outer heavy gauge beaded circumferential portion 30 of the mask wall 12 is provided. This serves to clamp the upper viewing lens or plate 56 along with the lower securement accessory plate 78 into a tightened circumferential teardrop mask shape on the frontal planar surface 14 of the mask. In other words, when the mask 10 is secured and held by turning of the respective bolts 122 and 124, the upper and lower bands 108 and 110 are drawn together.

The upper and lower bands 108 and 110 are generally provided in a form which accommodates the enlarged beaded circumferential portion 30 of the wall 12 of the mask. In other words, the bands 108 and 110 form a concavity or channel on their inside surface for clamping over the bead 30 surrounding the mask. The concavity is an extended channel into which the upper plate or viewing lens 56 and lower securement or accessory plate 78 can be held tightly by the sealing means of the enlarged elastomeric bead 30.

The mask is held on a wearer's head by means of a general conformation referred to as a spider 140. The spider has an upper strap 142 and lateral straps 144, 145, 146 and 147 (not seen). The lateral straps are identical in nature and substantially bilaterally symetrical in their placement. The five straps terminate at a middle or apex portion 150. The middle or apex portion 150 is received at the back of a diver's head and provides a web with the legs formed of the straps 142, 144, 145, 146 and 147 (not seen).

The spider 140 can be adjusted by pulling the legs and the straps 142 through 147 through the rings 42 and clamping them by the securement means 46. An enlarged T-shaped portion 160 at the end of each strap is utilized to prevent the straps 142 to 147 from slipping through the rings 42 inadvertently. In other words, the T member 160 is enlarged and of heavier gauge rubber, as well as being of a wider configuration than the interior width of the ring 42. This serves to prevent the slippage of the straps inadvertently through the rings, so that a diver can always maintain placement of the straps through the ring in a fascile manner.

USAGE

A second stage regulator is seated over the eliptical flange 90 of the plug 86 to accommodate the opening thereof. When the second stage regulator 18 is attached to the plug 86, and connected to a source of breathing gas, it enables a diver to breathe through the axial opening 98 thereof.

The mask is then slipped over a diver's facial configuration so that the flanges or other interior edges 24 fit comfortably against a diver's face. This serves to accommodate the diver and provide for a comfortable fit. The diver can then secure the spider 140 against the back of his head by pulling the straps 142 through 147 by means of the enlarged T-sections at whatever position the pressure should be applied in order to have a tight fitting seal against a diver's face. Thus, the accommodation of the mask against a diver's face is effectuated so that there is a substantial seal to prevent intrusion of ambient water.

After the foregoing, the diver can then adjust the plug 86 inwardly or outwardly, and up or down, with respect to the diver's mouth so that the distance between the oral opening of the diver and the plug flange 96 accommodates placement of the diver's chin in the lower cavity 76.

As can be appreciated, divers all have different facial configurations and the ability to move the plug 86 inwardly and outwardly, and up and down, enables a more suitable adjustment of the mask 10 for the diver.

One of the most important features of this mask when used with a recirculator, or other breathing devices, is that another diver can supply an emergency breathing supply without the removal of the mask. Two divers wearing this mask can each carry an emergency regulator system equipped with a plug 86 compatible with the mask. This allows the diver to use his own or the other diver's emergency system with a minimum of lost time by simply unplugging his malfunctioning plug 86 and inserting the emergency 86.

Also, in the event of flooding, the lower chamber need not be cleared of water. To proceed with breathing, only the mouthpiece need be cleared.

VARIATIONS

Many variations of the mask can be utilized in order to accommodate a diver's needs. Specifically, the mask can be formed from a neoprene, plastic material, or other elastomer. In addition thereto, the mask can have various circumferential configurations other than the specific teardrop conformation. In other words, the mask have outer walls 14 that are substantially circular or taper down into a lower cavity 76 of significantly smaller size than the one shown. Also, the upper cavity 70 can be of an exaggerated size beyond the size of the lower cavity 76.

The entire mask can have a sealing flange 24 of a different configuration in its cross section as well as having a different lip flanged partition 72 for sealing the upper cavity 70 from the lower chamber 76. In addition thereto, the plug 86 can be of any suitable cross sectional form as long as it provides a connection which can be moved inwardly or outwardly with respect to the interior area of the cavity 76. Additionally, the plate 78 can be formed so that it has openings 84 therethrough which will admit and accommodate the plug 86 in any manner. Furthermore, the entire area can be formed in a diaphragmatic configuration.

In addition to the foregoing, the accessory plate 78 can be formed so that it can receive a snorkel of a specific configuration through the opening 84. Also, the snorkel can be formed with any suitable oral breathing element or insert in the form of plug 86 to be suitably sealed within the opening 84.

The cavity 76 can be provided with various accessories for an intercommunication system in the form of a potted microphone. The microphone can be placed in the cavity 76 and held therein or allowed to float freely. Additionally, the plug 86 can be provided with a built-in microphone so that the plug not only serves as a connection between the second stage regulator 18, but also serves as a communication conduit.

As can be appreciated, the foregoing variances and adaptations of the invention are manifold. As a consequence, this invention is only to be read and understood in light of the following claims as to its scope and breadth thereof.

I claim:

1. A diving mask comprising:

a major casing having a wall portion defining a major cavity of said mask and a trailing edge thereof wherein said wall surfaces at the trailing edge are adapted for placement against a user's face;

a partition dividing the major cavity into upper and lower portions of the cavity providing upper and lower cavities substantially separated from each other during usage by a diver with a frontal opening in the lower cavity having a flanged groove surrounding the interior surface thereof;

a substantially stiffened member with less flexibility than said casing having a passage therein held in the frontal opening of the lower cavity in the flanged groove for sealing the frontal area thereof and adapted to receive a source of breathing gas through the opening in said member; and, a conduit passing through the passage of said substantially stiffened member and engaging the walls of said passage on the outer surface of said conduit to prevent the passage of water between said conduit and passage interface which is adapted to be connected at one end to a source of breathing gas, and which can slide inwardly and outwardly therethrough for removal and adjustment thereof with respect to a user's mouth.

2. The diving mask as claimed in claim 1 further comprising:

a nasal extension in the frontal area of said mask for receiving a user's nose.

3. The diving mask as claimed in claim 1 further comprising:

a purge valve within the lower cavity of said diving mask.

4. The diving mask as claimed in claim 1 further comprising:

a frontal opening in said upper cavity;

an upper viewing lens in the frontal opening of said upper cavity for partially sealing said upper cavity during use;

a lower plate comprising said member having an opening therein for sealing the general frontal area of said lower cavity;

means within said mask structure for receiving the lens and the lower plate in the form of a flanged groove; and, band means circumscribing at least a portion of said mask for clamping said upper and lower plates into said flanged groove.

5. The diving mask as claimed in claim 1 wherein:

said band is split and held in tension by a securement means.

6. The diving mask as claimed in claim 5 further comprising:

means for tightening the band in the form of a threaded member having oppositely pitched threads; and, means for receiving said threaded member in each of said respective bands so that when said threaded member is rotated, it can move into tightened position.

7. The diving mask as claimed in claim 1 further comprising:

communication means within said diving mask placed within the lower cavity.

8. The diving mask as claimed in claim 1 in combination with a second stage regulator; and, resonant means within said combination for allowing the passage of audio energy from the lower cavity to the surrounding environment.

9. The diving mask as claimed in claim 1 in combination with:

a snorkel passing through said passage in the lower plate which seals the cavity to provide said conduit in part.

* * * * *